US010233658B1

(12) United States Patent
Ligman

(10) Patent No.: US 10,233,658 B1
(45) Date of Patent: Mar. 19, 2019

(54) MULTI-ROTATIONAL CONCRETE SCREED APPARATUS FOR SCREEDING CONCRETE

(71) Applicant: Ligchine International Corporation, Floyds Knobs, IN (US)

(72) Inventor: Peter A. Ligman, Darien, WI (US)

(73) Assignee: Ligchine International Corporation, Floyds Knobs, IN (US)

( * ) Notice: Subject to any disclaimer, the term of this patent is extended or adjusted under 35 U.S.C. 154(b) by 0 days.

(21) Appl. No.: 15/785,067

(22) Filed: Oct. 16, 2017

Related U.S. Application Data

(60) Provisional application No. 62/408,374, filed on Oct. 14, 2016.

(51) Int. Cl.
*E04F 21/24* (2006.01)
*E01C 19/42* (2006.01)

(52) U.S. Cl.
CPC ..... *E04F 21/241* (2013.01); *E01C 19/42* (2013.01)

(58) Field of Classification Search
CPC ..... E04F 21/241; E01C 19/42
USPC ..... 404/83, 118, 120
See application file for complete search history.

(56) References Cited

U.S. PATENT DOCUMENTS 1,731,231 A 10/1929 Chenoweth
3,341,029 A 9/1967 Barkley et al.
3,377,933 A 4/1968 Dale
3,675,721 A 7/1972 Davidson et al.
3,721,054 A 3/1973 Hornagold
3,870,427 A 3/1975 Allen
3,901,616 A * 8/1975 Greening ..... E01C 19/4873 280/682
4,036,372 A 7/1977 Rao et al.
4,406,375 A 9/1983 Hockensmith
4,655,633 A 4/1987 Somero et al.
4,700,786 A 10/1987 Berry
4,770,304 A 9/1988 Woods
4,896,995 A 1/1990 Simmons
4,930,935 A * 6/1990 Quenzi ..... E01C 19/006 404/114
5,009,546 A 4/1991 Domenighetti et al.
5,039,249 A * 8/1991 Hansen ..... E01C 19/40 404/114
5,129,803 A 7/1992 Nomura et al.
5,217,320 A 6/1993 Cioffi
5,224,793 A * 7/1993 De Pol ..... E01C 19/15 404/114
5,234,281 A 8/1993 Somero et al.
5,515,654 A 5/1996 Anderson
6,129,481 A 10/2000 Tapio et al.
6,227,761 B1 5/2001 Kieranen et al.
6,328,115 B1 12/2001 Carter, Jr.
6,447,204 B1 9/2002 McDonald
6,481,924 B1 11/2002 Smolders et al.
6,530,721 B2 3/2003 Yost
6,695,532 B2 2/2004 Somero et al.
6,729,796 B1 5/2004 Green
(Continued)

*Primary Examiner* — Raymond W Addie
(74) *Attorney, Agent, or Firm* — Middleton Reutlinger

(57) ABSTRACT

A multi-rotational concrete screed to produce a level finished surface that includes a frame assembly, a boom assembly secured to the frame assembly at a first end and to a screed head at a second end, and a drive assembly. A powered turntable is positioned between the frame assembly and drive assembly permitting complete rotation of each with respect to the other.

17 Claims, 11 Drawing Sheets

(56) References Cited

U.S. PATENT DOCUMENTS

| | | | | |
|---|---|---|---|---|
| 6,857,816 | B2 | 2/2005 | Saito et al. | |
| 6,860,676 | B2 | 3/2005 | Pont Feixes | |
| 7,044,681 | B2 | 5/2006 | Quenzie et al. | |
| 7,121,762 | B2 | 10/2006 | Quenzie et al. | |
| 7,144,191 | B2 | 12/2006 | Kieranen et al. | |
| 7,175,363 | B2 | 2/2007 | Quenzie et al. | |
| 7,195,423 | B2 | 3/2007 | Halonen et al. | |
| 7,232,277 | B2 | 6/2007 | Corbitt | |
| 7,320,558 | B2 | 1/2008 | Quenzie et al. | |
| 7,396,186 | B2 | 7/2008 | Quenzie et al. | |
| 7,407,339 | B2 | 8/2008 | Halonen et al. | |
| 7,497,140 | B2 | 3/2009 | Blackwelder et al. | |
| 7,540,686 | B2 | 6/2009 | Heims | |
| 7,685,929 | B2 | 3/2010 | Mainville | |
| 8,152,409 | B1 * | 4/2012 | Ligman | E01C 19/006 404/118 |
| 8,591,142 | B2 | 11/2013 | Mittleman | |
| 8,794,868 | B2 | 8/2014 | Fritz | |
| 9,297,171 | B1 * | 3/2016 | Ligman | E04F 21/241 |
| 2003/0161684 | A1 | 8/2003 | Quenzi | |
| 2004/0076472 | A1 | 4/2004 | Holmes | |
| 2005/0141963 | A1 | 6/2005 | Holmes | |
| 2005/0263302 | A1 * | 12/2005 | Newnam | E02F 3/76 172/817 |
| 2006/0120801 | A1 | 6/2006 | Johnson | |
| 2007/0116520 | A1 | 5/2007 | Quenzie et al. | |
| 2010/0215433 | A1 | 8/2010 | Fritz | |
| 2011/0236129 | A1 * | 9/2011 | Guntert, Jr. | E01C 19/42 404/72 |
| 2012/0183350 | A1 | 7/2012 | Mittleman | |
| 2014/0331632 | A1 * | 11/2014 | Schots | B66C 23/94 56/15.5 |
| 2014/0363232 | A1 | 12/2014 | Pietila et al. | |

* cited by examiner

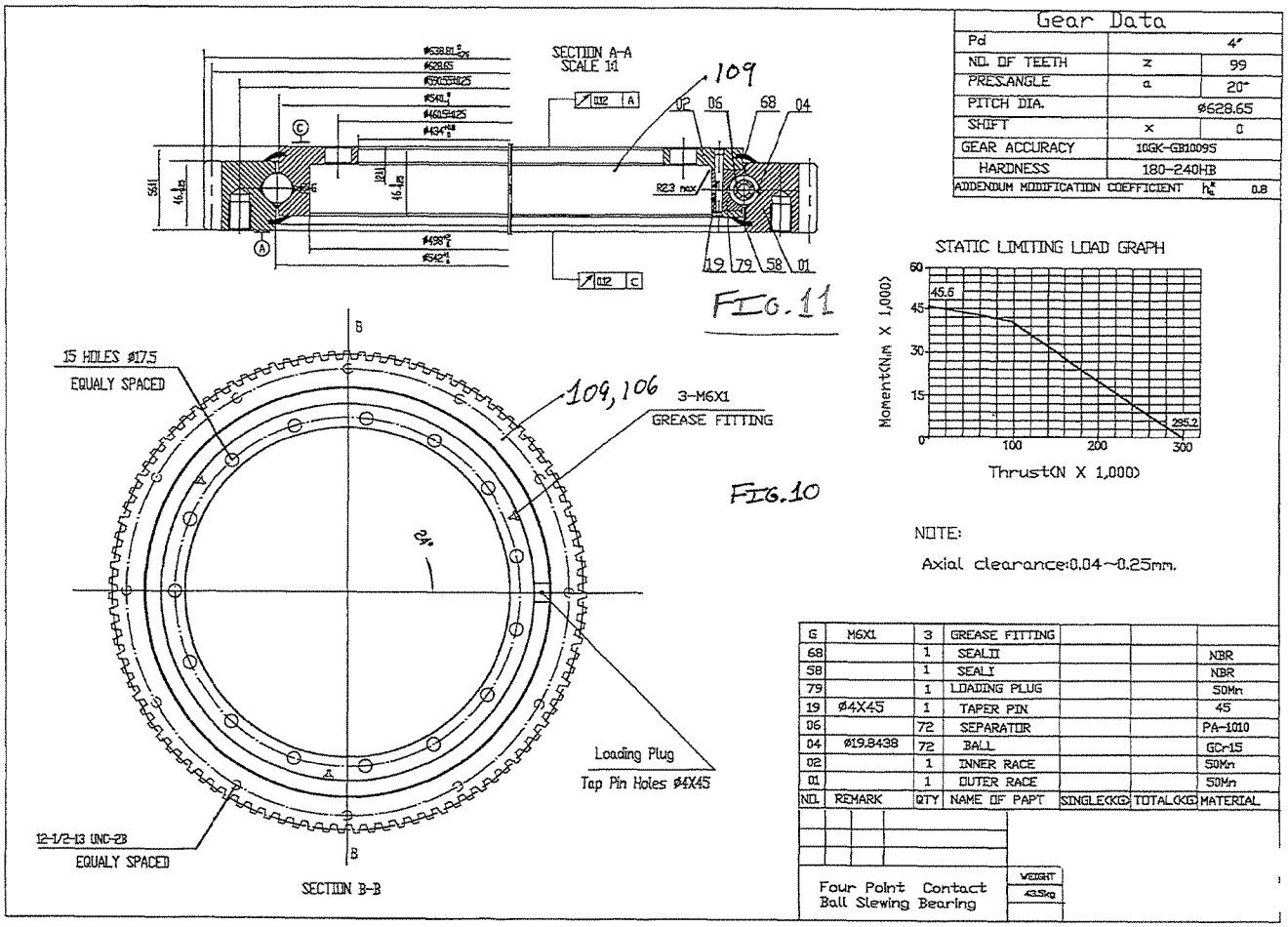
Gear Data
Pd 4"
NO. OF TEETH z 99
PRESSANGLE α 20°
PITCH DIA. ø628.65
SHIFT x 0
GEAR ACCURACY JIS-GB10095
HARDNESS 180-240HB
ADDENDUM MODIFICATION COEFFICIENT h*a 0.8
STATIC LIMITING LOAD GRAPH
Moment(N.m X 1,000)
Thrust(N X 1,000)
46.6
252.2
NOTE:
Axial clearance:0.04~0.25mm.
G M6X1 3 GREASE FITTING
68 1 SEALII NBR
58 1 SEALI NBR
79 1 LOADING PLUG S0Mn
19 ø4X45 1 TAPER PIN 45
06 1 SEPARATOR PA-1010
04 ø19.8438 72 BALL GC-15
02 1 INNER RACE S0Mn
01 1 OUTER RACE S0Mn
NO. REMARK QTY NAME OF PART SINGLE(KG) TOTAL(KG) MATERIAL
Four Point Ball Slewing Bearing Contact Bearing
SECTION A-A SCALE 1:1
109
FIG. 11
109, 106 3-M6X1 GREASE FITTING
FIG. 10
Loading Plug
Tap Pin Holes ø4X45
15 HOLES ø17.5 EQUALLY SPACED
12-1/2-13 UNC-2B EQUALLY SPACED
SECTION B-B

MULTI-ROTATIONAL CONCRETE SCREED APPARATUS FOR SCREEDING CONCRETE

BACKGROUND OF THE INVENTION

Field of the Invention

The present invention relates generally to a system and apparatus for troweling or screeding concrete and more specifically to a concrete screed apparatus for screeding or finishing a poured concrete surface. The screed apparatus of the instant invention is rotatable about a central axis such that the upper portion of the screed machine and the lower portion of the screed machine are independently and completely rotatable with respect to each other, thereby providing a multi-rotational screed system.

Description of the Related Art

In the construction industry when liquid concrete is poured to produce a finished surface it must be quickly and carefully smoothed or screeded, so that when the concrete sets it produces an even, level surface. Since this level surface is almost always a foundation for additional construction, machine base applications, or for vertical storage such as warehousing and shelving space, it is highly desirable to produce a surface that is consistently level over its entire area. In large poured areas it is unwieldy and labor intensive to manually level and smooth a poured concrete surface as well as extremely difficult to maintain a consistent finished grade.

In order to aid in the screeding of large surface area concrete pours, a variety of concrete screed or troweling machines have been accepted into use in the art. These machines typically include a screed head comprising a flat troweling surface for contacting the poured concrete. The screed head is typically mounted on a boom that is mechanically extended and retracted across the concrete surface to produce a smooth surface finish. This process is commonly termed "screeding" the concrete. Many of these prior art devices include various systems for leveling the screed head relative to a reference plane such that the finished surface is relatively flat once it is screeded. Furthermore, many screeders have various drive systems for maneuvering the screed around the area being poured.

The drive systems in prior art screeding devices may encompass many different configurations of wheels and tracks, often mounted to and supporting a turret that rotates with respect to the wheels and/or tracks. Prior art screeding devices often comprise a frame having a centrally mounted turret from which a boom is extended. One such system is disclosed in U.S. Pat. No. 5,039,249 to Hansen et al. These turret type screeds provide for some maneuverability of the screed head with respect to the concrete surface since the turrets are capable of rotation via a driven gear or similar mechanism. However, these screed systems are typically quite complex and costly due to the need for complex and unwieldy mechanical and electrical controls to rotate the turret and extend the boom, not to mention the power required to position the turret. In fact, while many prior art screed devices are available, a great deal of concrete screeding is still accomplished by hand due to the size, lack of maneuverability, and cost of these prior art screeders.

Additionally, turret-type systems are extremely complex in terms of mechanical construction and the control systems required for their operation since they necessarily have a telescoping boom that extends from a central point of attachment to the screeder. In order to withstand the rigors of continuous use in construction environments, booms are typically comprised of a metal alloy which makes them quite heavy. As a result, when the boom is fully extended outwardly from the turret, there is some variation in the level of the screed head since a great deal of weight is secured to a single point of the screed apparatus, namely the rotatable turret to which the terminal portion of the boom must be secured.

Other significant drawbacks with many prior art screeding machines include the difficulty in positioning the screed for a new screeding pass across unfinished concrete. Once the screed boom is fully retracted and a screeding pass has been completed, the screed must be reversed, moved sideways parallel to the concrete pour and then repositioned proximate the next section of poured concrete to be screeded. While turret type machines facilitate this process by permitting the screed to be moved parallel to the concrete pour, their complexity, expense and relatively poor ability to accurately level the finished surface make them undesirable.

Accordingly, there is a need in the art for an apparatus, system and method of screeding and troweling concrete that provides a consistently level finished surface with a minimum of mechanical and electrical system complexity and the ability to quickly rotate and maneuver a screed apparatus around a concrete pour.

Other features, objects and advantages of the present invention will become apparent from the detailed description of the drawing Figures taken in conjunction with the appended drawing Figures.

BRIEF DESCRIPTION OF THE DRAWING FIGURES

FIG. 10 is a top view of a slew ring assembly in accordance with one embodiment of the invention;

FIG. 11 is a side view of a slew ring assembly in accordance with one embodiment of the invention;

DETAILED DESCRIPTION OF THE PREFERRED EMBODIMENT(S)

Figure 1:
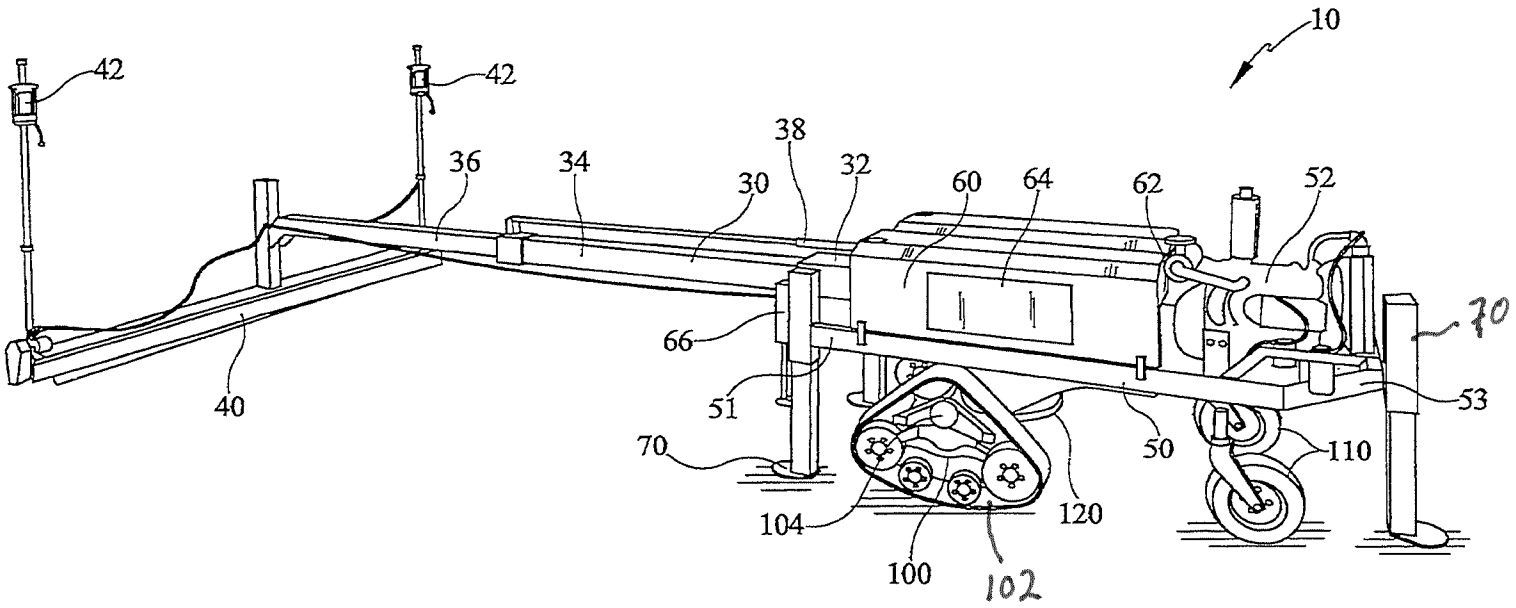
FIG. 1 is a perspective view of a concrete screeder with an extended boom in accordance with one embodiment of the present invention.
Figure 2:
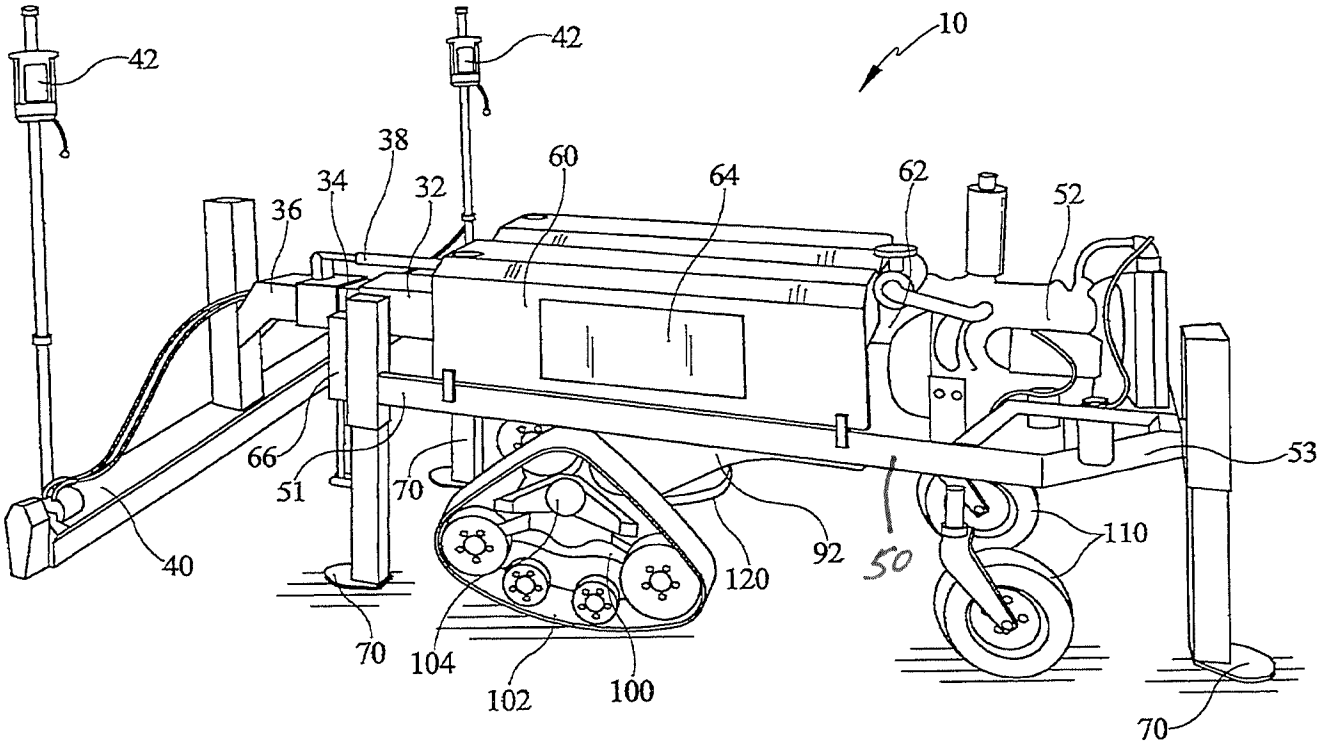
FIG. 2 is a perspective view of a concrete screeder with a retracted boom in accordance with one embodiment of the present invention.
Figure 3:
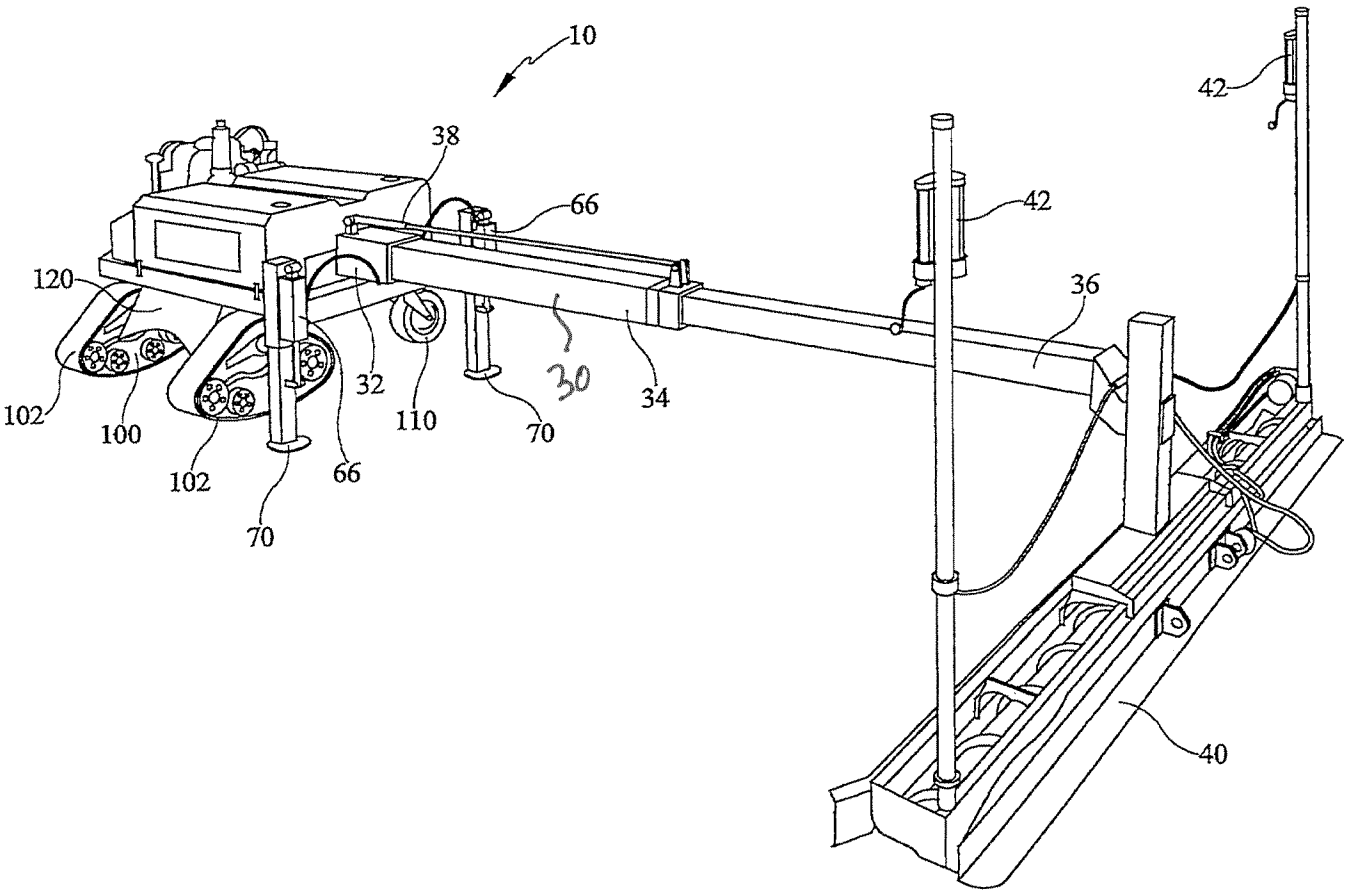
FIG. 3 is a perspective view of a concrete screeder in accordance with one embodiment of the present invention.
Figure 4:
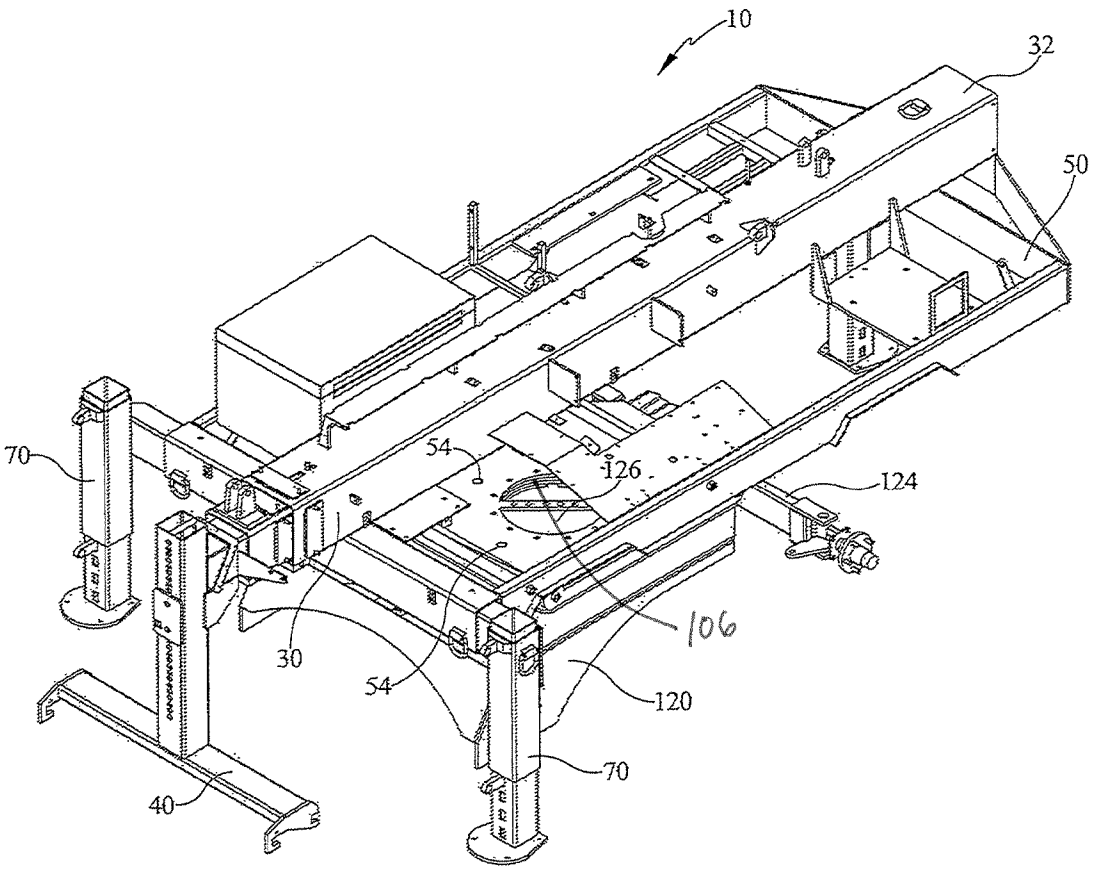
FIG. 4 is a perspective view of a concrete screeder frame assembly in accordance with one embodiment of the present invention.
Figure 5:
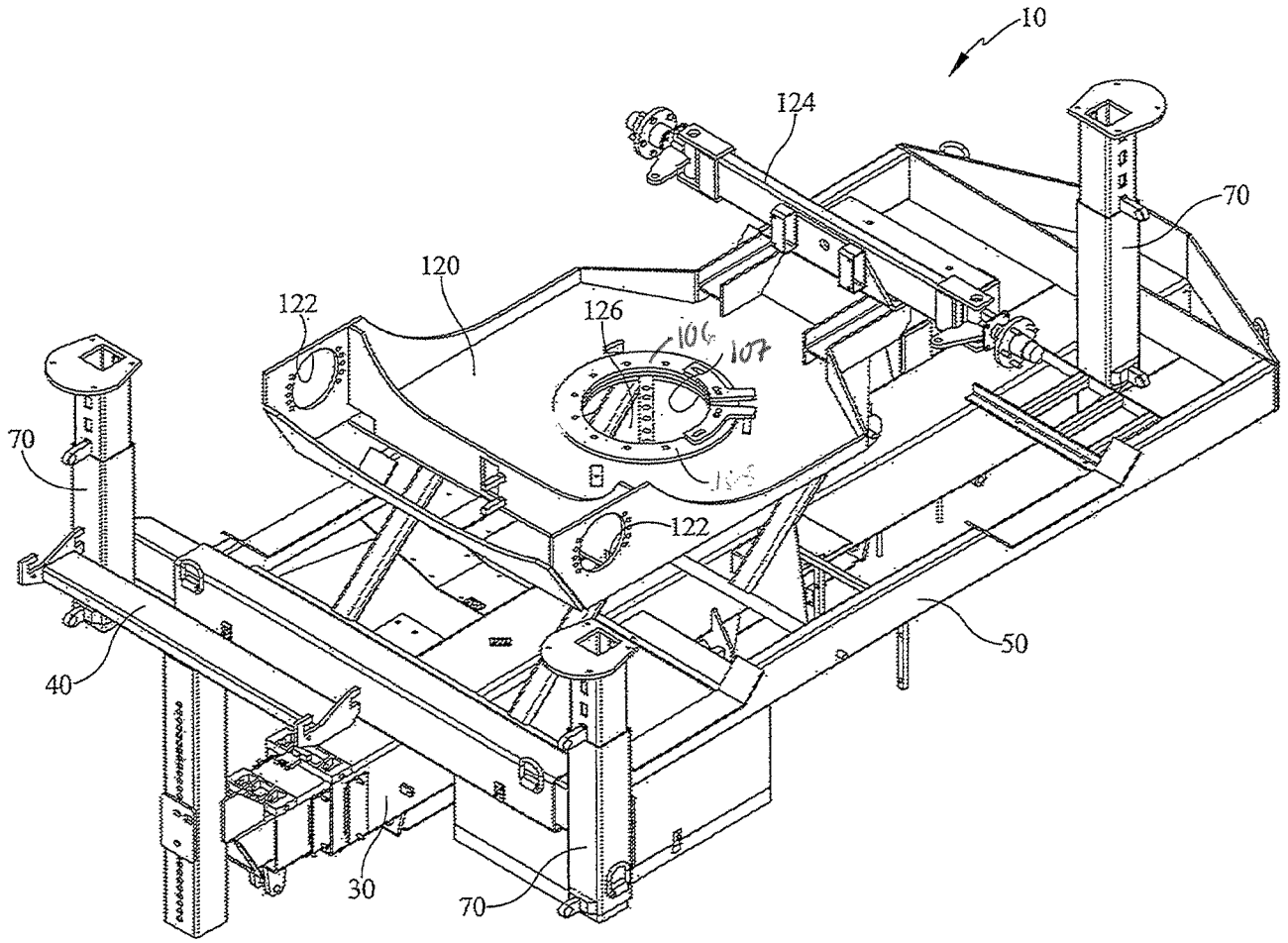
FIG. 5 is a perspective view of a concrete screeder frame assembly in accordance with one embodiment of the present invention.
Figure 6:
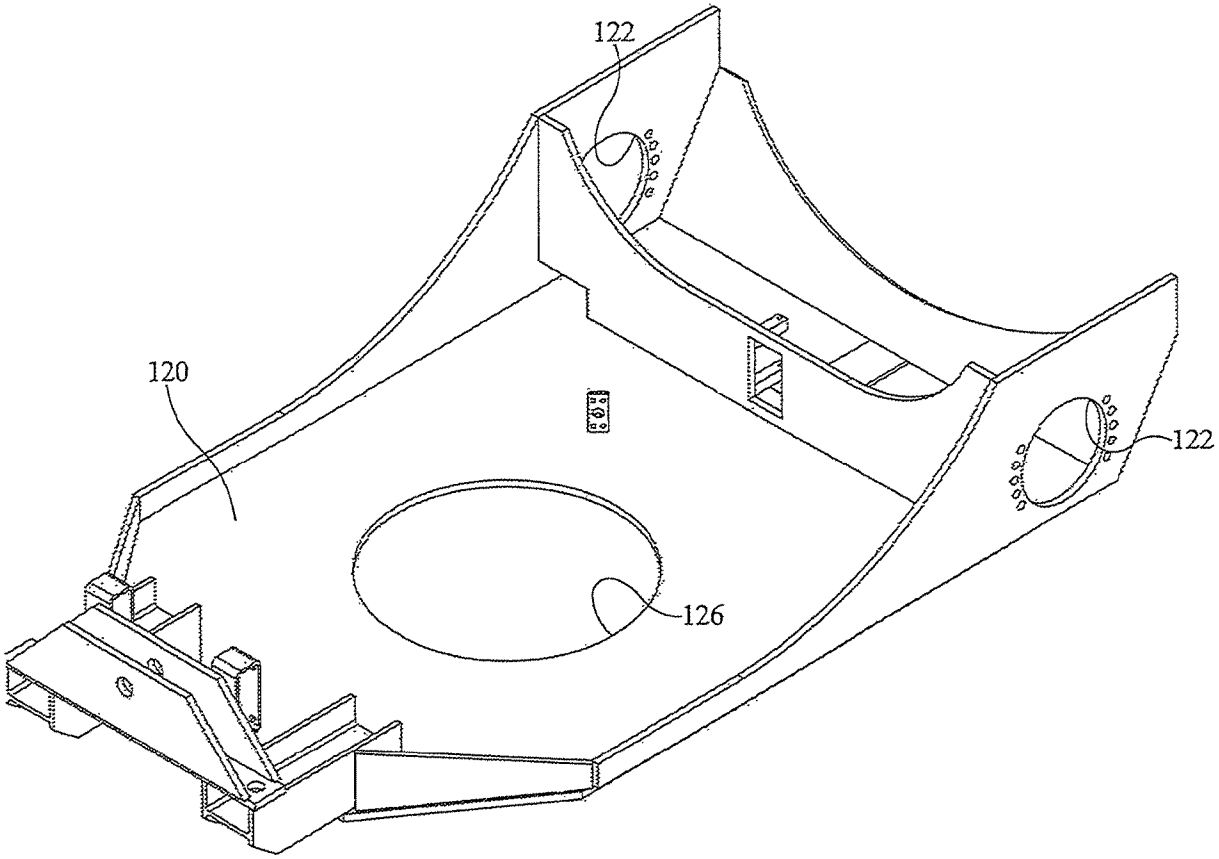
FIG. 6 is a perspective view of a concrete screeder undercarriage assembly in accordance with one embodiment of the present invention.
Figure 7:
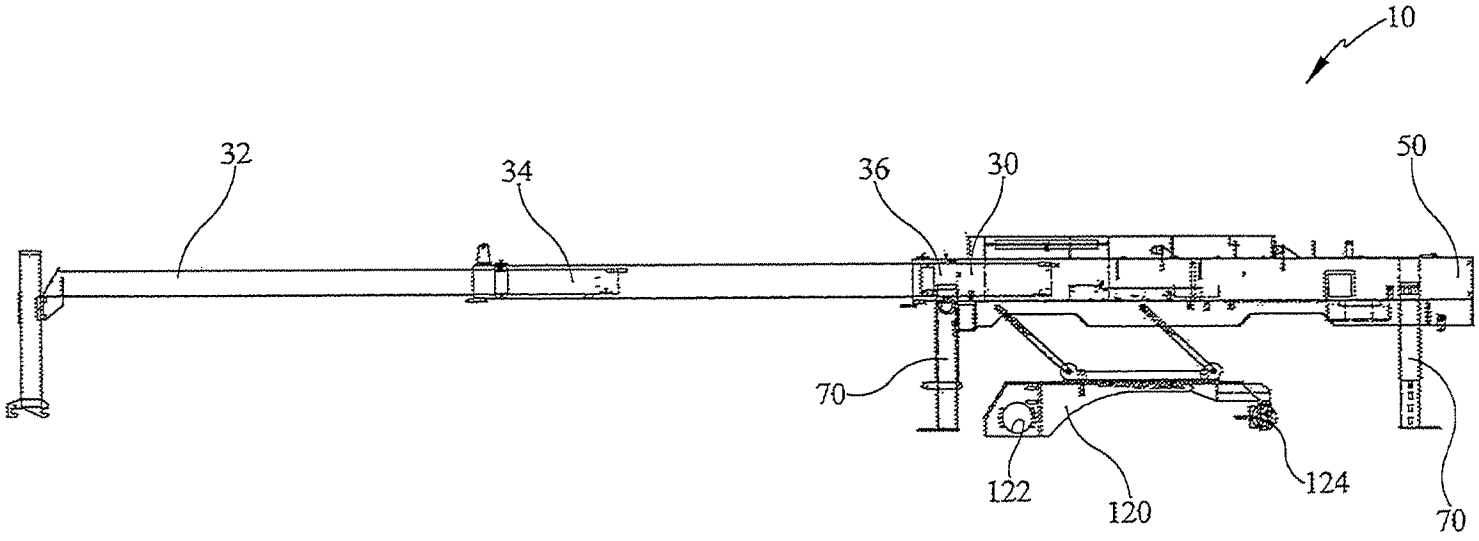
FIG. 7 is a perspective view of a concrete screeder frame assembly in accordance with one embodiment of the present invention.

Referring now to drawing FIGS. 1-3, and in accordance with various embodiments of the invention, the system described herein overcomes the aforementioned difficulties in the prior art by providing a concrete screed apparatus 10 having a telescopic boom assembly 30 and rigid frame assembly 50 that boom assembly 30 is secured directly thereto. In some aspects and non-limiting embodiments the invention may also comprise a conventional internal combustion engine 52 having an output shaft coupled to a hydraulic assembly 60, for supplying pressurized hydraulic fluid to a plurality of components necessary to operate screeder 10 via a plurality of electrically actuated control valves.

The invention further includes a drive assembly 100 that is mounted on an drive frame 120 such that it is rotatable with respect to frame 50, to allow screeder 10 to be maneuvered around a concrete pour by completely rotating frame 50 with respect to drive frame 120, as will be discussed further herein below. Drive frame 120 may include an aperture 126 therein through which various screed 10 hydraulic or electrical lines may be routed. In some embodiments, drive frame 120 may include an axle 124 for mounting drive wheels, and mounting ports 122 for tracks or other driven wheels. Futhermore, in some aspects and embodiments of the invention drive assembly 100 may include a plurality of driven or un-driven wheels 110 to facilitate positioning of the screed 10 or additionally and alternatively drive assembly 100 may incorporate a track-drive apparatus 102 as will be discussed further below.

In various aspects and embodiments, the present invention comprises a telescopic boom assembly 30 having an exterior 32, intermediate 34 and interior 36 booms, wherein the intermediate 34 and interior 36 booms may be extended and retracted by means of a single hydraulic cylinder 38 supplied by pressurized fluid from hydraulic assembly 60. Exterior boom 32 is secured directly to frame assembly 50 so that when frame 50 is leveled, so is boom assembly 30.

Referring again to drawing FIGS. 1-3 and in accordance with some aspects and embodiments of the present invention, a concrete screeding apparatus 10 comprises a rigid frame assembly 50 on which a conventional internal combustion engine 52 is mounted. Engine 52 supplies power via a conventional output shaft to a hydraulic assembly 60, also mounted on frame assembly 50. Hydraulic assembly 60 may typically include a pump 62 for pressurizing hydraulic fluid and a plurality of electrically actuated control valves (not shown) for supplying pressurized hydraulic fluid to a plurality of components as discussed in detail below.

Hydraulic assembly 60 may further comprise a control system (not shown) which may include a microprocessor, data memory, inputs and outputs, a wireless transceiver 64, and requisite wiring to electrically connect the control system to the plurality of valves. Throughout the specification the operation of hydraulic cylinders will be understood to be effected through the use of a conventional hydraulic system 60, comprising electrically actuated hydraulic valves and a control system for operating said valves.

In some aspects and embodiments of the invention a plurality of adjustable stabilization legs 70 may be slidably secured in a generally vertical orientation to frame assembly 50 at a plurality of points around the perimeter thereof. As shown in the drawing Figures, in an exemplary but non-limiting embodiment of the invention two opposed legs 70 are secured to frame assembly 50 at a forward end 51 thereof while a single leg 70 is secured to a rear end 53 of frame assembly 50. One of ordinary skill in the art will appreciate that the number and positioning of legs 70 around frame assembly 50 may be varied without departing from the scope of the present invention. Each leg 70 may further be secured to a hydraulic cylinder 66 which is also secured to frame 50 at a point, and that is utilized to level boom assembly 30 with respect to a reference plane by raising or lowering legs 70, thereby leveling the entire screeding apparatus 10.

FIGS. 1-9 further depict a drive system 100 rotatably secured to frame assembly 50 for maneuvering screeder 10. Drive assembly 100 may comprise a plurality of wheels 110, which may be driven or not depending upon the requirements of the screed 10. In one embodiment at least one wheel 110 is a driven or powered wheel 110, thereby providing the ability to maneuver screed 10 using drive assembly 100. In one alternative embodiment of the present invention, drive assembly 100 may include a pair of spaced hydraulically driven tracks 102 and a pair of spaced un-driven pivotable wheels 110, both secured to an undercarriage 120.

Figure 12:
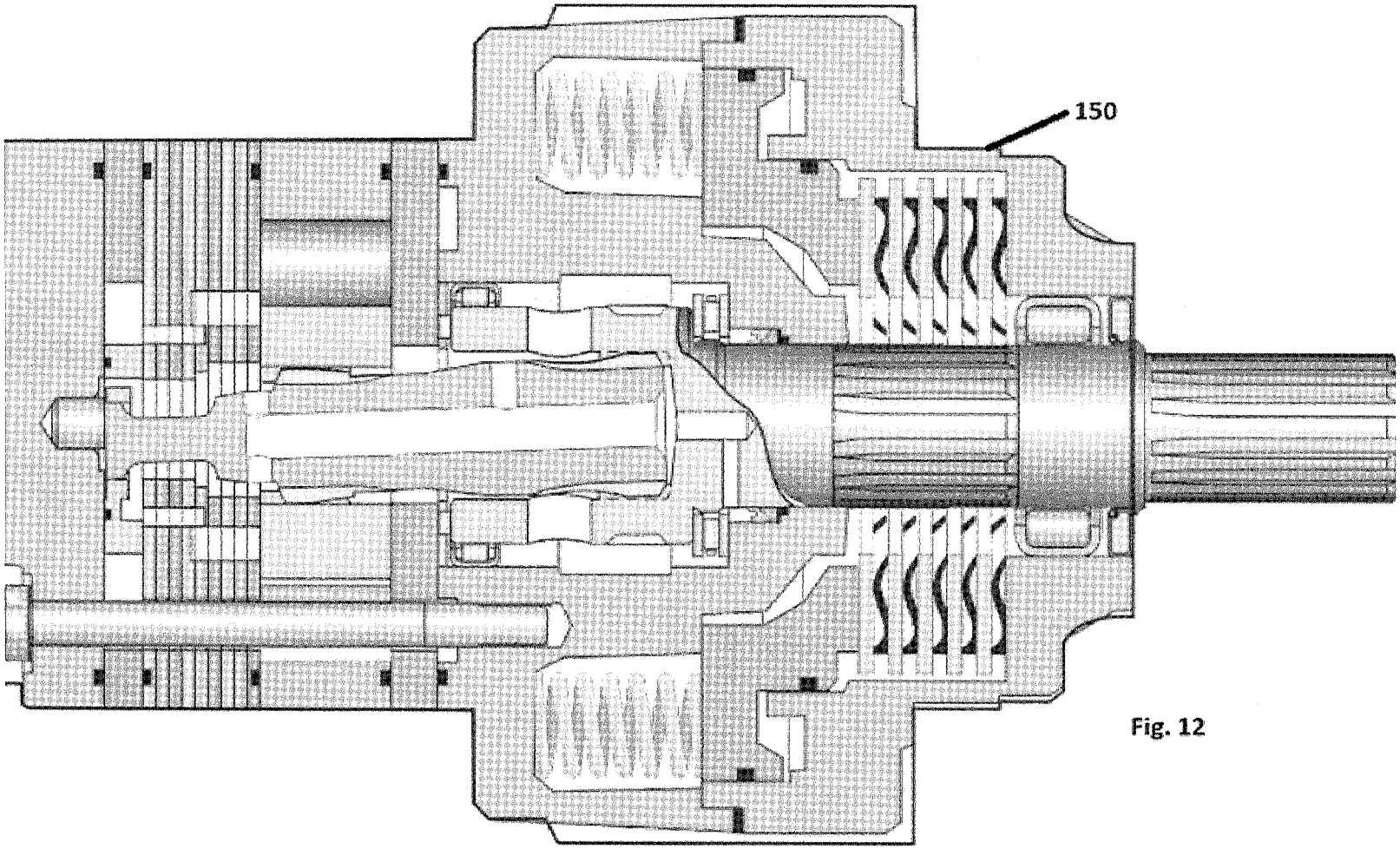
FIG. 12 is a schematic view of a hydraulic motor in accordance with one embodiment of the invention.
Figure 13:
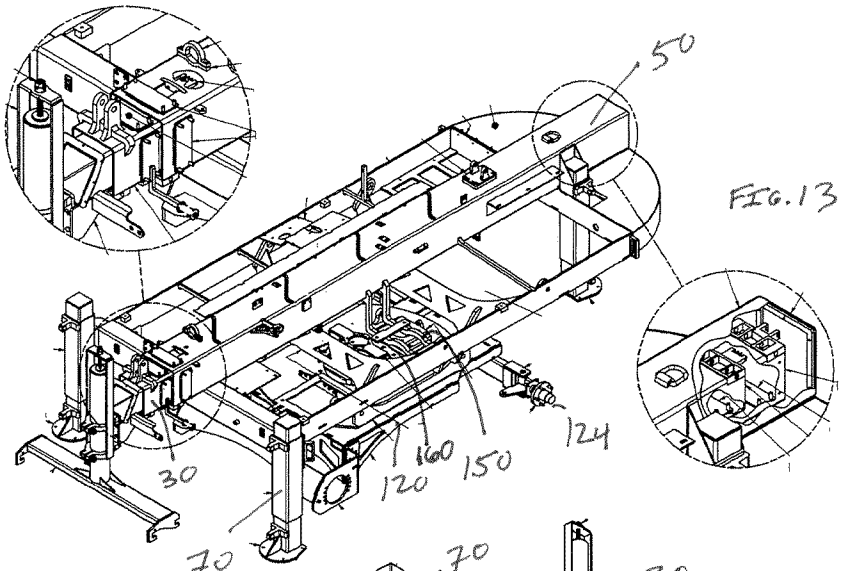
FIG. 13 is a perspective view of a concrete screed frame and drive assembly with a retracted boom in accordance with one embodiment of the present invention.
Figure 14:
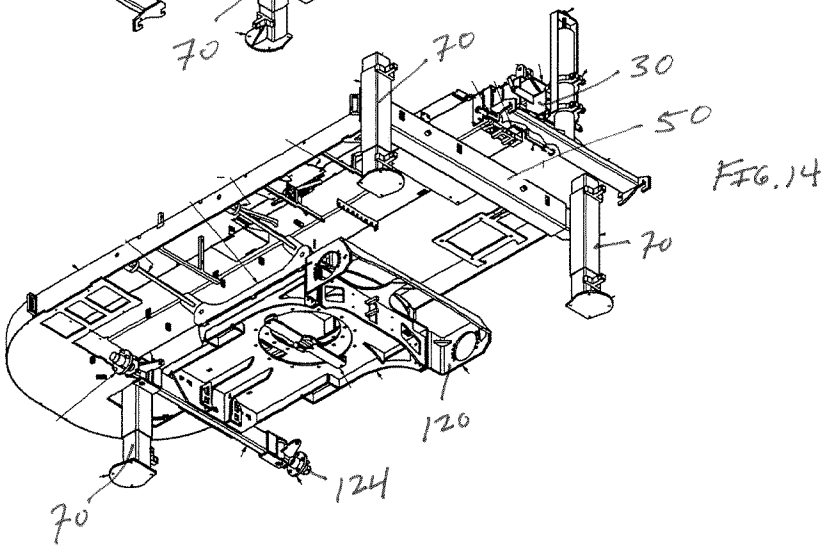
FIG. 14 is a perspective view of a concrete screed frame and drive assembly with a retracted boom in accordance with one embodiment of the present invention.

Referring now to FIGS. 4-14, in some aspects and embodiments the invention 10 further comprises a powered turntable 106 that has a top mounting plate 107 that may be secured to frame 50 and a bottom mounting plate 108 that is secured to a drive frame 120 to which wheels 110 may be secured and on which screed 10 rests. Turntable 106 may engage a motor 150 that operates to rotate top mounting plate 107 with respect to bottom mounting plate 108. As depicted in FIG. 12, motor 150 may be a hydraulic brake motor capable of rotating top mounting plate 107 and its concomitant load. Alternatively, motor 150 may comprise an electric motor without departing from the scope of the invention. Since top mounting plate 107 and bottom mounting plate 108 are free to rotate independently of each other, frame 50 and drive frame 120, which are secured to top and bottom mounting plates 107, 108 respectively, are also free to rotate independently of each other, thereby advantageously providing a multi-rotational concrete screed 10.

In a yet further aspects and embodiments of the invention as depicted in FIGS. 10 and 11, a slew ring 109 may be provided between top mounting plate 107 and bottom mounting plate 108 to facilitate rotation and reduce friction between top 107 and bottom 108 mounting plates.

Figure 8:
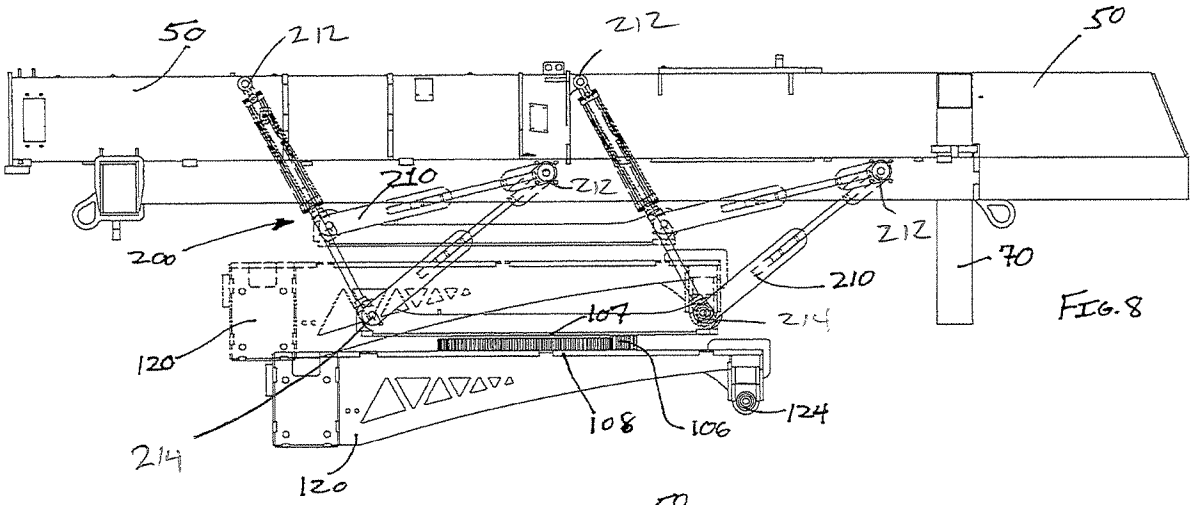
FIG. 8 is a view of a screed frame and drive frame assembly in accordance with one embodiment of the invention.
Figure 9:
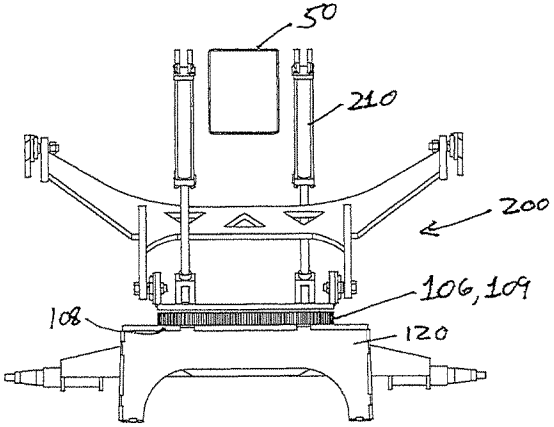
FIG. 9 is a view of a screed frame and drive frame assembly in accordance with one embodiment of the invention.

As best seen in FIGS. 8 and 9, and in accordance with some embodiments of the invention screed 10 may include an adjustable lifting assembly 200 that comprises a plurality of actuators 210 secured between frame assembly 50 and mounting plate 107, thereby enabling an operator to vary the distance between frame assembly 50 and drive assembly 100 by operation of actuators 210. In various non-limiting embodiments, actuators 210 may comprise hydraulically powered cylinders or electrically powered linear actuators without departing from the scope of the instant invention. Actuators 210 may be secured at one end 212 to frame 50 and secured at a second end 214 to drive assembly 100. By extending actuators 210 drive frame 100 may be lowered (or alternatively moved away from frame 50) to thereby elevate frame 50 off the ground (when wheels 110 are resting on the ground) independently of the operation of legs 70, thereby enabling an operator to rotate frame 50 360 degrees by operation of powered turntable 106.

Additionally and in some alternative embodiments of the invention drive frame 100 may be raised upwardly (elevated or moved toward frame 50) by operation of actuators 210 while legs 70 are resting on a surface, thereby suspending drive frame 100 and wheels 110 off the ground and underneath frame 50. In this embodiment drive frame 100 may then be rotated completely around with respect to frame 50 by operation of powered turntable 106, thereby providing for a multi-rotational screed 10. In this exemplary but non-limiting embodiment of the invention drive frame 100 and wheels 110 can be oriented parallel to the concrete pour, such that screed 10 may be quickly moved into position for the next screeding pass without the need for reorientation of the screed boom assembly 30.

In various non-limiting aspects of the invention a rotary hydraulic manifold 160 may be provided to route or pass hydraulic fluid through the powered, rotating turntable 106, thereby supplying the requisite hydraulic fluid in embodiments of the invention utilizing hydraulically powered and/or steered wheels 110. Additionally and alternatively, in some embodiments a rotary electrical coupling may be employed to route electrical wiring through rotating turntable 106, where wheels 110 or other screed 10 components are electrically powered. By utilizing rotary hydraulic and/or electrical elements in combination with turntable 106, the present invention permits complete independent rotation of the top portion or frame 50 of screed 10 with respect to the bottom portion or drive assembly 100, thereby resulting in a multi-rotational screed apparatus.

In various other embodiment of the invention, turntable 106 may be powered or driven directly via a shaft attachment from an electric motor 150, via a gear or transmission mechanism, through operation of a driven pulley, belt, or chain, or through any direct motor drive, hydraulic, internal combustion, or electric. Furthermore, in some embodiments turntable may be pneumatically powered by operation of compressed air produced by a compressor (not shown) that is in turn powered by engine 52.

In operation, and as best seen in FIGS. 1 and 3, drive frame 120, and thus drive assembly 100 and wheels 110, are readily rotated in any direction, seen in FIG. 3, so that screed 10 may be moved parallel to a concrete pour line. Drive assembly 100, in some aspects of the invention, may include a hydraulic motor or motors 104 operatively coupled to a wheel or wheels 110 that are supplied pressurized fluid from pump 62, thereby driving screed 10 by operation of wheels 110.

Additionally, in accordance with some aspects and embodiments one of ordinary skill in the art will understand that although some exemplary embodiments of screed 10 utilize a boom-type screed device, the multi-rotational turntable 106 may be employed with a variety of different screed types without departing from the scope of the present invention.

In operation, screed apparatus 10 may be driven forward to approach a concrete pour, and legs 70 may be extended to stabilize and level screeder 10 while the boom assembly 30 is extended and screed head 40 engages the concrete surface. While legs 70 are extended, drive assembly 100 may be elevated off the ground by operation of actuators 210 such that wheels 110 (and/or tracks 102 where used) are suspended in the air. At this point, drive frame 120 may be easily rotated to orient wheels 110 parallel to the concrete pour surface, or in any required direction. Once the screed 10 pass is completed, legs 70 may then be lowered and drive assembly 100 can be utilized to move screeder 10 parallel to the pour surface to make another screed pass. Once in position, legs 70 are once again extended and screeder 10 operation continues as disclosed herein above.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A multi-rotational concrete screed to produce a level finished surface comprising:

a frame assembly;

a boom assembly secured to said frame assembly at a first end and to a screed head at a second end;

a drive assembly secured to a drive frame;

a powered turntable having a top mounting plate secured to said frame assembly, and a bottom mounting plate secured to said drive frame, said top mounting plate and said bottom mounting plate rotatable in either direction with respect to one another;

a motor for turning said top mounting plate relative to said bottom mounting plate; and an adjustable lifting assembly secured between said frame assembly and the top mounting plate of said turntable, said lifting assembly capable of varying the distance between said frame assembly and said turntable.

2. The apparatus as claimed in claim 1 wherein said turntable is gear driven.

3. The apparatus as claimed in claim 1 wherein said turntable is pulley driven.

4. The apparatus as claimed in claim 1 wherein said turntable is chain driven.

5. The apparatus as claimed in claim 1 wherein said turntable is driven by a direct connection to a motor shaft.

6. The apparatus as claimed in claim 1 wherein said turntable is hydraulically driven.

7. The apparatus as claimed in claim 1 comprising:

a plurality of adjustable legs secured at a plurality of points to said frame assembly, said legs extendable to lift or lower said frame assembly relative to said surface.

8. The apparatus as claimed in claim 1 wherein said motor for turning said top plate relative to said bottom plate is a hydraulic motor.

9. The apparatus as claimed in claim 1 comprising:

a rotary hydraulic manifold for routing pressurized hydraulic fluid through said turntable.

10. The apparatus as claimed in claim 1 comprising:

a plurality of actuators secured between said frame assembly and said drive assembly.

11. The apparatus of claim 10 wherein said plurality of actuators are hydraulic actuators.

12. The apparatus of claim 10 wherein said plurality of actuators are linear actuators.

13. The apparatus as claimed in claim 1 wherein said turntable is driven directly by an electric motor.

14. The apparatus as claimed in claim 13 further comprising:

a rotary electrical coupling for supplying power to electric components that rotate with said bottom mounting plate of said turntable.

15. The apparatus as claimed in claim 1 wherein said drive assembly comprises a plurality of wheels.

16. The apparatus as claimed in claim 15 wherein at least one of said plurality of wheels is steerable.

17. The apparatus as claimed in claim 15 wherein at least one of said wheels is hydraulically driven and steerable.

* * * * *